US010260834B2

(12) United States Patent
White

(10) Patent No.: US 10,260,834 B2
(45) Date of Patent: Apr. 16, 2019

(54) ARCHERY GRIP SYSTEM

(71) Applicant: Vitalz Outdoors, LLC, Georgetown, TX (US)

(72) Inventor: Russell W. White, Austin, TX (US)

(73) Assignee: Vitalz Outdoors, LLC, Georgetown, TX (US)

( * ) Notice: Subject to any disclaimer, the term of this patent is extended or adjusted under 35 U.S.C. 154(b) by 0 days.

(21) Appl. No.: 15/006,199

(22) Filed: Jan. 26, 2016

(65) Prior Publication Data

US 2016/0138885 A1 May 19, 2016

Related U.S. Application Data

(63) Continuation-in-part of application No. 14/156,622, filed on Jan. 16, 2014, now Pat. No. 9,377,268.

(60) Provisional application No. 61/753,522, filed on Jan. 17, 2013.

(51) Int. Cl.

| | |
|---|---|
| ***F41B 5/00*** | (2006.01) |
| ***F41B 5/10*** | (2006.01) |
| ***F41B 5/14*** | (2006.01) |
| ***F41G 3/06*** | (2006.01) |
| ***F41G 1/467*** | (2006.01) |

(52) U.S. Cl.

CPC ..... *F41B 5/14* (2013.01); *F41B 5/1403* (2013.01); *F41B 5/1426* (2013.01); *F41G 1/467* (2013.01); *F41G 3/06* (2013.01)

(58) Field of Classification Search

CPC .. F41B 5/00; F41B 5/14; F41B 5/1403; F41B 5/1426; F41B 5/148; F41B 5/0031; F41B 5/10; F41G 1/467; F41G 3/06

See application file for complete search history.

(56) References Cited

U.S. PATENT DOCUMENTS

| | | | | |
|---|---|---|---|---|
| 4,257,385 A | | 3/1981 | Stewart | |
| 5,119,796 A | * | 6/1992 | Dehlbom | F41B 5/0031 124/23.1 |
| 5,243,958 A | * | 9/1993 | Shepley, Jr. | F41B 5/0031 124/23.1 |
| 5,333,595 A | * | 8/1994 | Heffron | F41B 5/0052 124/23.1 |
| 5,469,834 A | * | 11/1995 | Higgins | F41B 5/14 124/23.1 |
| 5,551,413 A | * | 9/1996 | Walk | F41B 5/14 124/23.1 |

(Continued)

OTHER PUBLICATIONS

United States Patent and Trademark Office, Final Office Action dated Dec. 21, 2015 and Reply filed on Feb. 22, 2016 in U.S. Appl. No. 14/156,622.

*Primary Examiner* — John E Simms, Jr.

(74) *Attorney, Agent, or Firm* — Trop, Pruner & Hu, P.C.

(57) ABSTRACT

A system for bow gripping is disclosed. A system incorporating teachings of the present disclosure may include a grip component configured to couple to a bow. In some embodiments, the grip component may interact and/or attached to an archer's lead hand. Some components may have a third metacarpal offset that encourages a grip angle of over twenty degrees. Depending on design goals, the encouraged grip angle may also be larger or smaller than twenty degrees. The grip component may also include a mechanism for attaching the component to an archer's bow or hand.

10 Claims, 6 Drawing Sheets

(56) References Cited

U.S. PATENT DOCUMENTS

| | | | | |
|---|---|---|---|---|
| 5,615,663 | A | 4/1997 | Simonds | |
| 5,853,000 | A * | 12/1998 | Torgerson | F41B 5/14 124/88 |
| 2006/0081232 | A1* | 4/2006 | Woodland | F41B 5/0094 124/25.6 |
| 2009/0293855 | A1* | 12/2009 | Danielson | F41G 1/35 124/87 |
| 2010/0115778 | A1* | 5/2010 | Gorsuch | F41G 1/467 33/265 |
| 2011/0132344 | A1* | 6/2011 | Moon | F41B 5/14 124/88 |
| 2011/0222046 | A1* | 9/2011 | Overstreet | F41G 1/467 356/4.01 |
| 2011/0259309 | A1* | 10/2011 | Oppenheim | F41B 5/14 124/23.1 |
| 2013/0047379 | A1 | 2/2013 | Zilke | |
| 2013/0098344 | A1* | 4/2013 | Morris, II | F41B 5/1484 124/25.6 |
| 2014/0216433 | A1* | 8/2014 | Kingsbury | F41B 5/1426 124/89 |

* cited by examiner

ARCHERY GRIP SYSTEM

This application is a continuation-in-part of U.S. patent application Ser. No. 14/156,622, filed Jan. 16, 2014, which claims priority to U.S. Provisional Patent Application Ser. No. 61/753,522, filed Jan. 17, 2013, the contents of both which are hereby incorporated by reference.

TECHNICAL FIELD

The following disclosure relates to archery equipment, and more particularly to a gripping system for improved shooting.

BACKGROUND

Generally speaking, archery is the practice of shooting arrows from a bow. In its most rudimentary form, it has been around for over 10,000 years. In modern times, archery is used as both a hunting technique and a recreational activity.

DETAILED DESCRIPTION

As mentioned above, archery is used as both a hunting technique and a recreational activity. In both scenarios, accuracy is of the utmost importance. Using bow sites and mechanical releases can help, but they are relatively ineffective if the archer cannot find and maintain a proper shooting position at full draw and release. It is the process of finding and maintaining this proper shooting position that leads to accurate shooting for most archers.

Figure 3B:
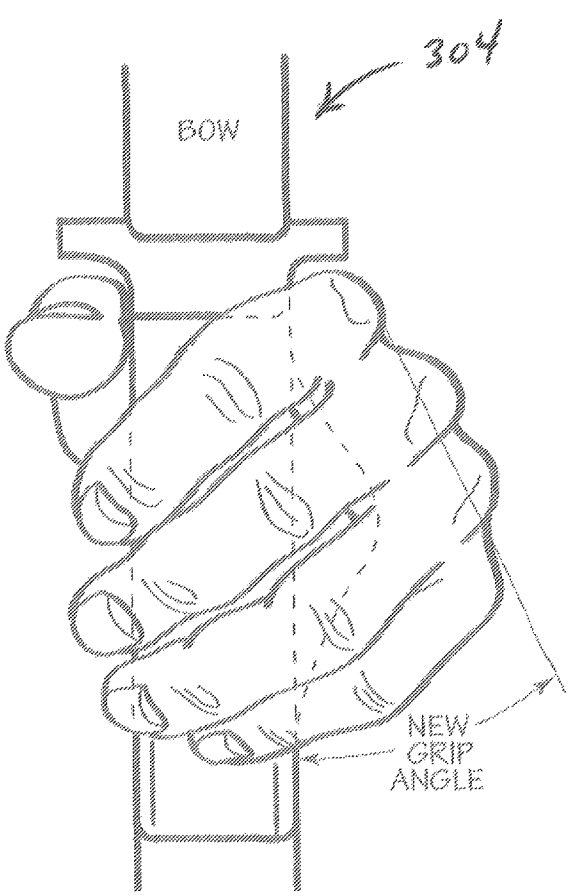
FIG. 3A illustrates a grip and FIG. 3B illustrates a grip incorporating teachings of the present disclosure for improving grip alignment.
Figure 3A:
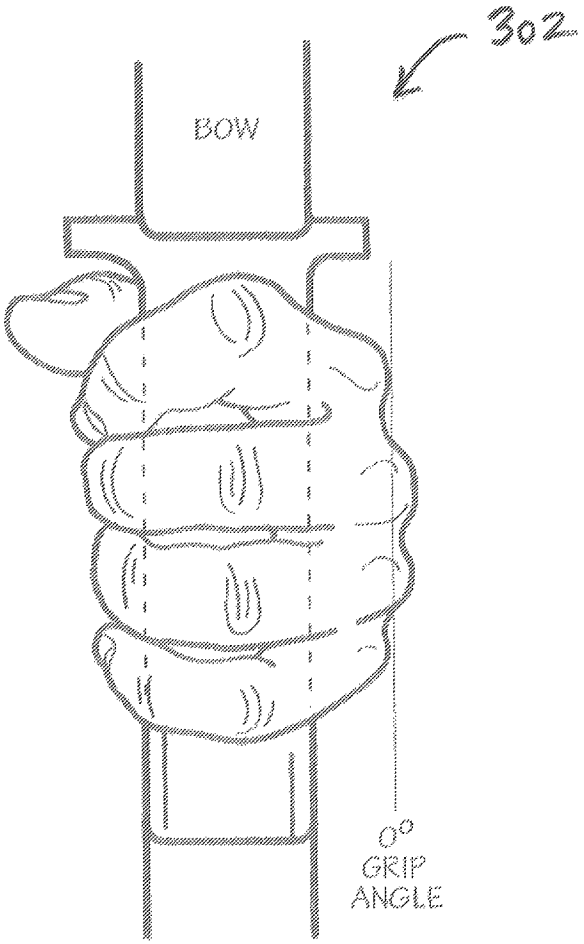
FIG. 3A PRIOR ART

Among other benefits that may result from the teachings disclosed herein, an archer using the described gripping systems may experience improved accuracy. The improved accuracy may result from the archer's enlarged grip angle. A conventional grip design can make it difficult for the archer to find the proper shooting position. Modern bows invite users to grab the bow grip and to wrap their fingers all the way around the grip as shown in image 302 of FIG. 3A. The result is that the knuckles on the back of the archer's lead-hand (the one holding the bow) define a grip angle that is in line or parallel to the limb-to-limb line of the bow. A parallel grip angle like this defines a zero degree grip angle. As the pinky knuckle of the lead hand is rotated away from the bow, the grip angle grows. For example, if the archer grips the bow such that the back of the hand faces upward and the bow limbs remain perpendicular to the ground, the defined grip angle would be ninety degrees.

As mentioned above, modern grips encourage zero degree grip angles. This is especially true for "ergonomic" grips that include finger depressions that are aligned perpendicular to the limb-to-limb line of the bow and/or palm mounds that fill the hollow formed in the palm area when a person closes his or her fist. It appears that grip design often results from having an individual squeeze a moldable material and then replicating the squeezed shape of the moldable material in the provided grip. The result is often a grip that promotes a zero degree grip angle.

Gripping the bow with a zero degree grip angle can create at least two problems for the typical archer. First, the archer can inadvertently "torque" the bow such that the archer actually twists the bow at release. This twisting throws the arrow off line. Second, a zero degree grip angle can force the meat of the forearm into the string path of the bow. The result is often a painful brushing of the string against the forearm after release. It is not uncommon to see an archer wearing an arm guard on the lead arm to protect the forearm skin from the bowstring. While the guard does protect the archer's arm, the string slapping against the guard can make consistent shot placement very difficult. Moreover, because the string slap from modern bows can be very painful, many archers develop two bad habits, namely, a flinching at release and a bending of the lead arm elbow.

In addition to other benefits apparent to one skilled in the art, the teachings of the present disclosure may help archers maintain a grip angle over zero degrees and a consistent body position when using a bow. As depicted in the figures, a bow may include a grip component that is unitary. The grip component could be an entire grip system that includes a grip, end caps, metacarpal offsets, etc. such as the system depicted in FIGS. 1A and 1B. In some cases, a grip component may help an archer to maintain a desired grip angle like the grip angle depicted in image 304 of FIG. 3B. The angle may be greater than twenty degrees and may be between thirty and sixty degrees. In other cases, the desired grip angle may include the smaller range of between forty and fifty degrees. In still other cases, an instructor or coach may narrow the desired range for a given archer to a very specific grip angle. For example, a given archer's physiology may dictate a preferred grip angle of thirty-two degrees. A different archer's physiology may dictate a preferred grip angle of forty-three degrees. To assist the archer in consistently repeating a specific grip angle or working within a grip angle range, a bow grip incorporating teachings of the present disclosure may include a third metacarpal offset. In some embodiments, the grip may include a fourth and a fifth metacarpal offset. In addition, the actual amount of offset may be varied or variable to allow for finer tuning of an archer's grip angle. It should be understood that the metacarpal offset can be located at various positions along the metacarpal. For example, a designer may locate the offset such that it rests under the middle finger knuckle of the lead hand. Such a location may make it more difficult for an archer to grip a bow in a manner that creates a zero degree grip angle.

In practice, the inclusion of one or more metacarpal offsets on a bow grip may disallow the wrap around gripping that creates the conventional zero degree grip angle. It should be understood that the metacarpal offsets could be implemented in many different ways depending on the design and cost preferences of the designer. For example, metacarpal offsets could be built into a factory bow grip, included on an aftermarket replacement grip, included in a lead-hand shooting glove, included in a bow grip cover that attaches to a traditional bow grip, some combination of these options, and/or some other appropriate technique for encouraging proper grip angles.

In a glove embodiment, a designer may elect to include a thumb-to-forefinger webbing structure that dissipates or reduces the amount of pressure felt by the webbing portion between a forefinger and a thumb of the archer's lead hand at full draw. The thumb-to-forefinger webbing structure could be made from a fabric, a plastic insert, a rubber insert, and/or some combination of these. In addition, the webbing structure could be sewn into a glove such that a load bearing structure is formed into a forefinger loop on one end and a thumb loop on the other. The glove may also include a thenar region pad. As an archer comes to full draw, a great deal of pressure is felt in the thumb/forefinger web and the thenar region of the lead hand. A glove with a thenar region pad may help to dissipate some of this otherwise acute pressure.

However formed, a system incorporating teachings of the present disclosure could be modular and allow for the removal and insertion of different metacarpal offsets. For example, a modular system could include a small sized offset that creates a twenty-five degree grip angle for a given archer, a medium sized offset creates a thirty-five degree grip angle, and a larger sized offset that creates a forty-five degree grip angle. These and other characteristics of the disclosed grip system may be better understood by referencing the figures.

Figure 1B:
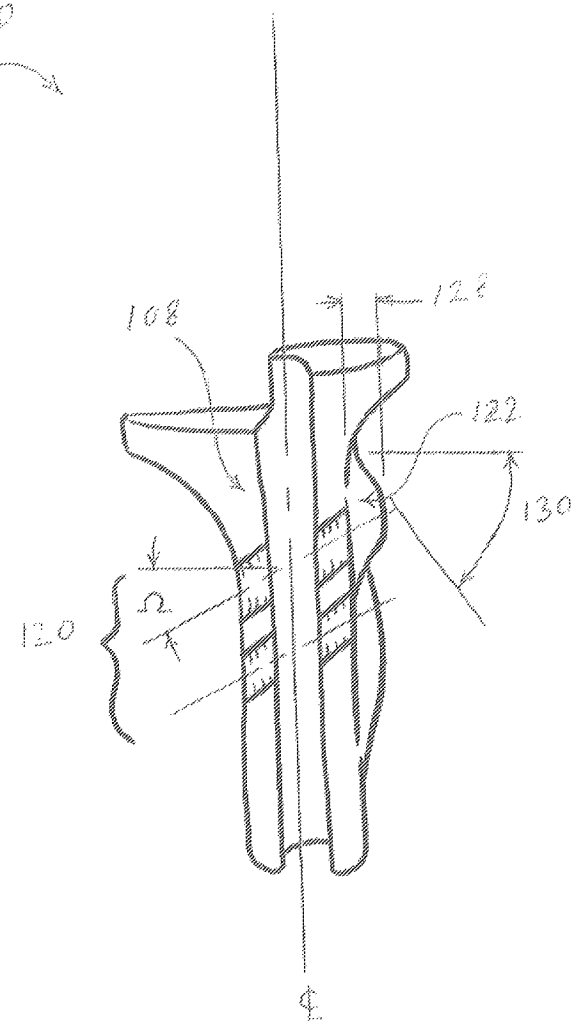
FIGS. 1A and 1B illustrate multiple views of a grip system incorporating teachings of the present disclosure for improving grip alignment.
Figure 1A:
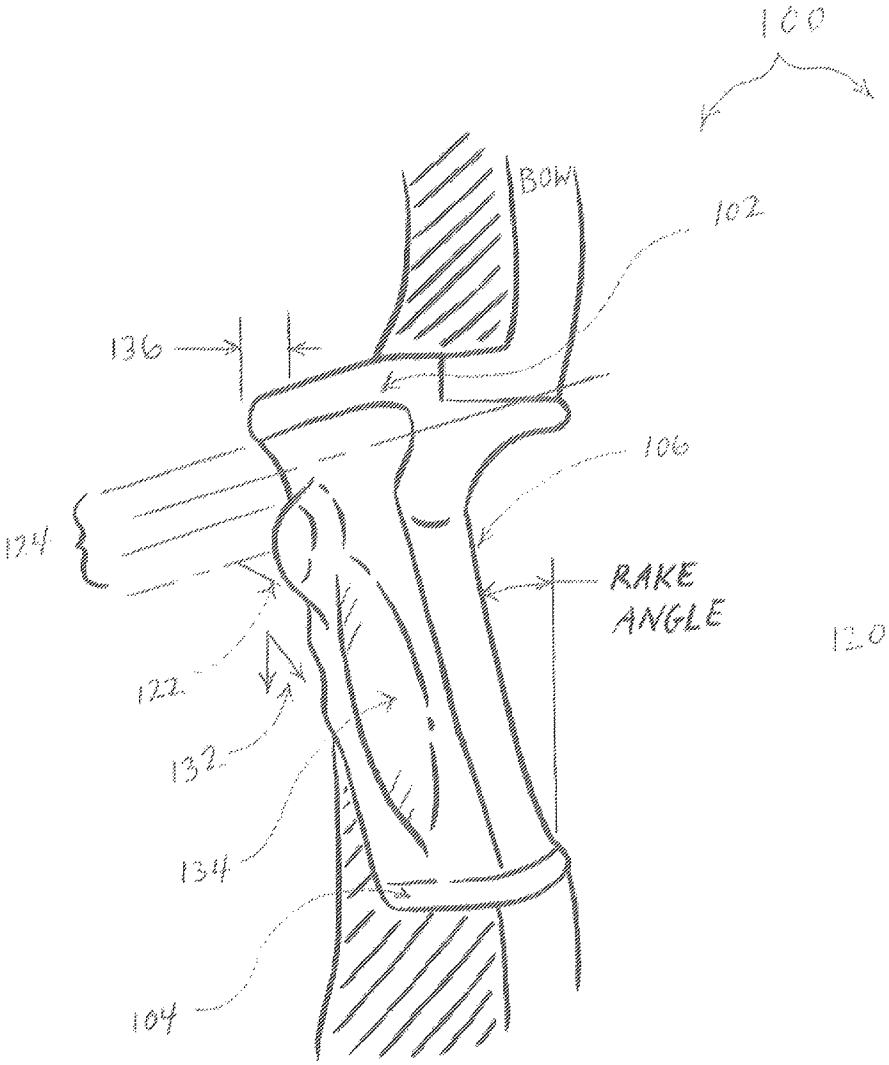

As explained above in the brief description of the figures, FIGS. 1A and 1B illustrate a grip system 100 incorporating teachings of the present disclosure for improving grip alignment. As shown, grip system 100 is a grip system that could be included on a factory bow or added as a replacement grip to an existing bow. System 100 may include one, two, or more component pieces that can be permanently or removably connected to one another to form system 100. Depending on design concerns, system 100 can be made from a single material such as rubber, plastic, wood, metal, etc. In one embodiment, the selected material is non-pliable and capable of maintaining its size and shape. In other embodiments, system 100 may be formed from more than one material. In such an embodiment, selected materials may include a non-pliable material and a pliable gel like material that "gives" a little in response to pressure.

In a version of system 100 made from more than one material, a designer may choose to create system 100 from more than one type of rubber, more than one type of plastic, more than one type of wood, more than one type of metal, and/or various combinations of material types. For example, system 100 may have a metal core, a wood overlay, a rubber metacarpal insert, and plastic end caps.

As shown in FIG. 1A, system 100 includes a top end cap 102 and a bottom end cap 104. Caps 102 and 104 can identify separate pieces of a gripping system and/or general locations on a gripping system. System 100 also includes a thenar surface 106. In use, surface 106 can interact with the webbing between an archer's thumb and forefinger as well as the thenar space of the archer's lead hand. Depending on design goals, surface 106 can have a flat cross section or a convex cross section that extends out and into the webbing of the archer's hand. In addition, surface 106 may be designed with or without a rake angle. In practice, if a gripping system has a zero degree rake angle, surface 106 would be parallel to the bowstring. In some embodiments, system 100 may have a ten to twenty degree rake angle. In such an embodiment, the rake angle would result in a "canting forward" of the thumb and forefinger away from the archer at full draw.

As depicted, system 100 also includes a front surface 108 with finger depressions 120. As shown, depressions 120 are not perpendicular to the limb-to-limb line of the bow. As shown, depressions 120 are angled down and away from the archer's palm. This angled depression design may assist the archer in finding a proper grip angle. System 100 also includes a third metacarpal offset 122 that is located such that it will fall under the middle finger knuckle of an archer's hand. Offset 122 is formed such that it creates a forefinger channel 124 that allows the second metacarpal of the archer's lead hand to rest in channel 124. In system 100, the width of channel 124 is fixed. In other embodiments, channel 124 may be adjustable to account for a wide range of hand sizes.

System 100 includes a fixed version of offset 122 with a predefined width, a predetermined offset amount 128, a predetermined feathering angle 130, and a fixed tailing angle 132. In other embodiments, one or more of these offset characteristics may be adjustable. As shown, system 100 also includes a small palm mound 134 on the palm-facing surface 136. In other embodiments, palm mound 134 may be removed to facilitate the finding of a proper grip angle.

Depending on the embodiment deployed, many of the above-described characteristics may be altered and/or alterable. For example, a designer may change the location of offset 122, the rake angle, the cross section of surface 106, the size and location of channel 124, the amount of overhang 136 created by top end cap 102, the amount of overhang created by bottom end cap 104, etc. Moreover, though FIGS. 1A and 1B depict system 100 as including several characteristics and components, a designer may choose to add more and/or to remove one or more of the ones depicted in FIGS. 1A and 1B. All of these changes can be made without departing from the teachings of the present disclosure.

Figure 2:
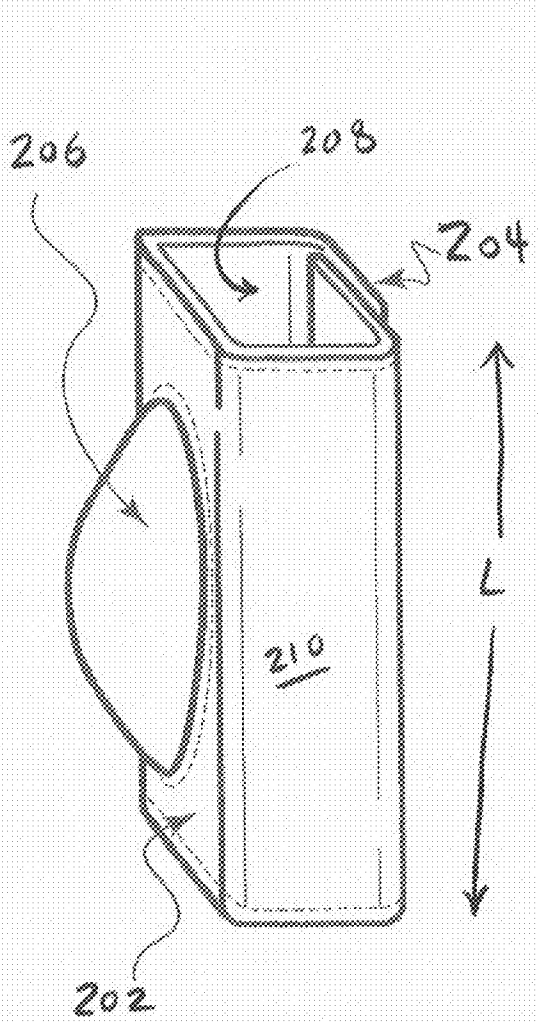
FIG. 2 depicts a grip sleeve incorporating teachings of the present disclosure in order to provide a shooting aid for archers.

As mentioned above, FIG. 2 depicts a grip sleeve system 200 incorporating teachings of the present disclosure. System 200 includes a sleeve 202 that is configured to at least partially wrap around an existing bow grip. In some embodiments, sleeve 202 may have a length dimension that is approximately equal to or smaller than a length dimension of the existing bow grip. In some embodiments, the length dimension may be the same or longer than the length dimension of the existing bow grip. As depicted, sleeve 202 is a complete sleeve that wraps all the way around the existing grip. Sleeve 202 opens up to wrap around the existing grip and then reseals using a hook and loop closure mechanism 204. Other closure mechanisms could also be used. For example, sleeve 202 could include laces that tie or a clasping mechanism. In other embodiments, sleeve 202 could clip onto the existing grip. For example, sleeve 202 may be designed such that it does not completely wrap around the existing grip. In such an embodiment, sleeve 202 may have a relatively rigid shape that is configured to clip onto the existing grip.

As shown, sleeve 202 wraps the existing grip along the entire length of the existing grip. In other embodiments, sleeve 202 may include one, two, or more strips that wrap all the way around the existing grip while leaving much of the existing grip uncovered. In such an embodiment, each of the strips may include its own clasping mechanism. In some embodiments, the size and clasping mechanisms chosen for a sleeve may allow the sleeve to be attached to an existing grip in more than one location. The ability to move system 200 into different mounting positions on an existing grip may effectively allow an archer to adjust the location of an included metacarpal offset.

As shown, system 200 includes a third metacarpal offset 206 that is attached to sleeve 202. In embodiments of system 200 that allow the system to be attached in slightly different positions on an existing bow, this offset 206 may be moved to fit a given archer's hand. In addition, offset 206 may take on varying sizes and shapes depending upon design goals of the developer and hand sizes of archers. Moreover, offset 206 may be formed from one or more types of material. For example, offset 206 may include one or more of a plastic material, a rubber material, a leather material, a metal material, a wooden material, a woven material, and/or some other material that is suitable for performing the objective of offset 206.

As shown, offset 206 is sewed into sleeve 202. A designer could choose other techniques for attaching offset 206 to sleeve 202. In one embodiment, sleeve 202 may be formed to include a pocket into which offset 206 can be removably placed. In such an embodiment, a designer could provide several offsets having various sizes. An archer could shoot his or her bow with each of the offsets to determine which one yields the best results. The archer may then place the chosen offset into the pocket of sleeve 202.

As mentioned above, offset 206 can be connected to sleeve 202 using one or more of several different techniques. System 200 could be formed such that offset 206 and sleeve 202 are part of a unitary system. Offset 206 can be permanently or removeably affixed to sleeve 202. Offset 206 could be glued, sewed, tied, stapled, shrink fit, pocketed, etc. to sleeve 202. However connected, an archer may want offset 206 to remain in a relatively fixed position relative to the existing bow grip. To help make this happen, a designer may rely on one or more techniques. For example, the designer may choose a specific material for sleeve 202 that facilitates the sleeve's ability to stay in a relatively fixed location once it has been attached to an existing bow grip. The material may include a stretchable material like spandex or neoprene. Once clasped or locked in place, the stretchable material may help to hold system 200 in place. A designer may also choose to include a non-slip material on an inside surface 208 of sleeve 202 that resists slipping around the existing grip. Similarly, the designer may choose the same non-slip material or some other desired material for the exterior surface 210 of system 200. The material and/or surface texture of exterior surface 210 may be chosen to feel good in the archer's hand.

Figure 4:
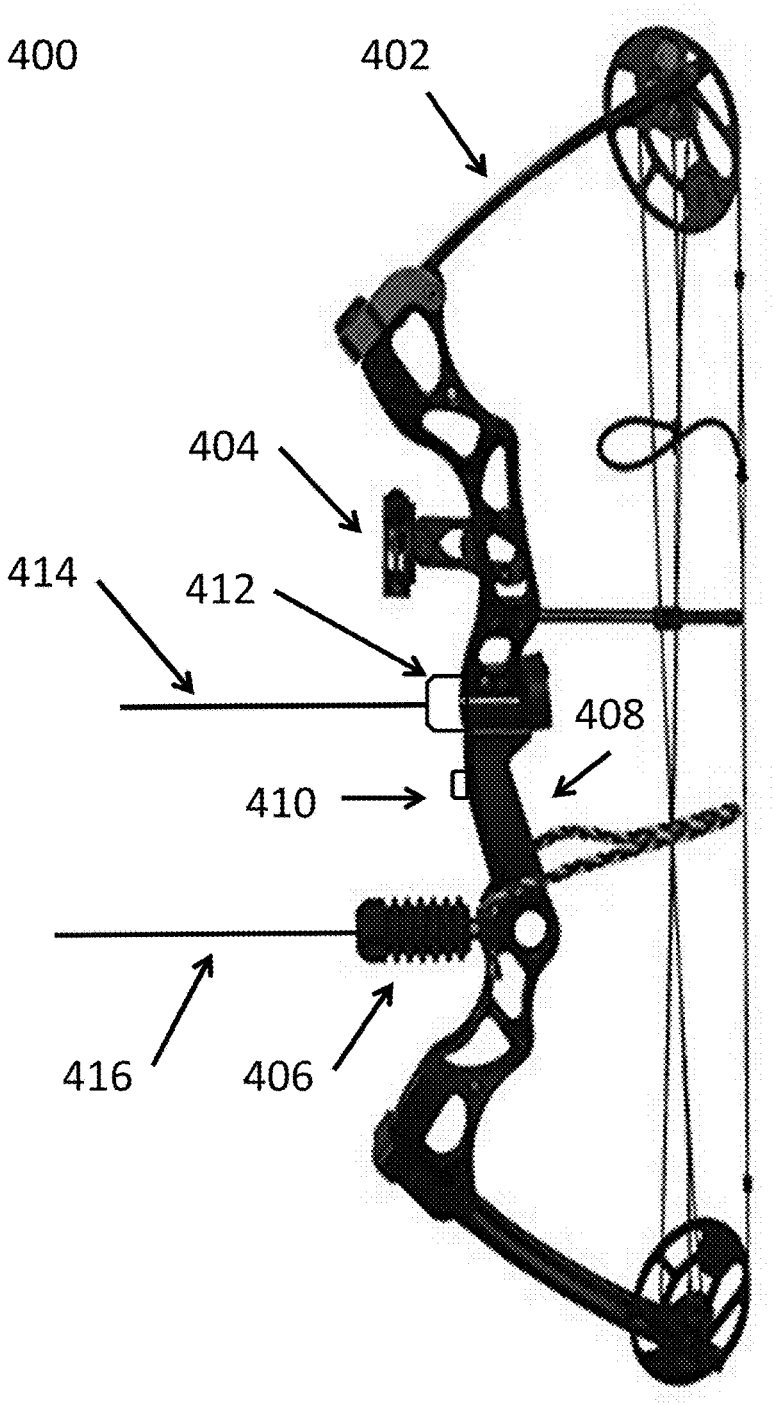
FIG. 4 illustrates an archery system incorporating teachings of the present disclosure.
Figure 5:
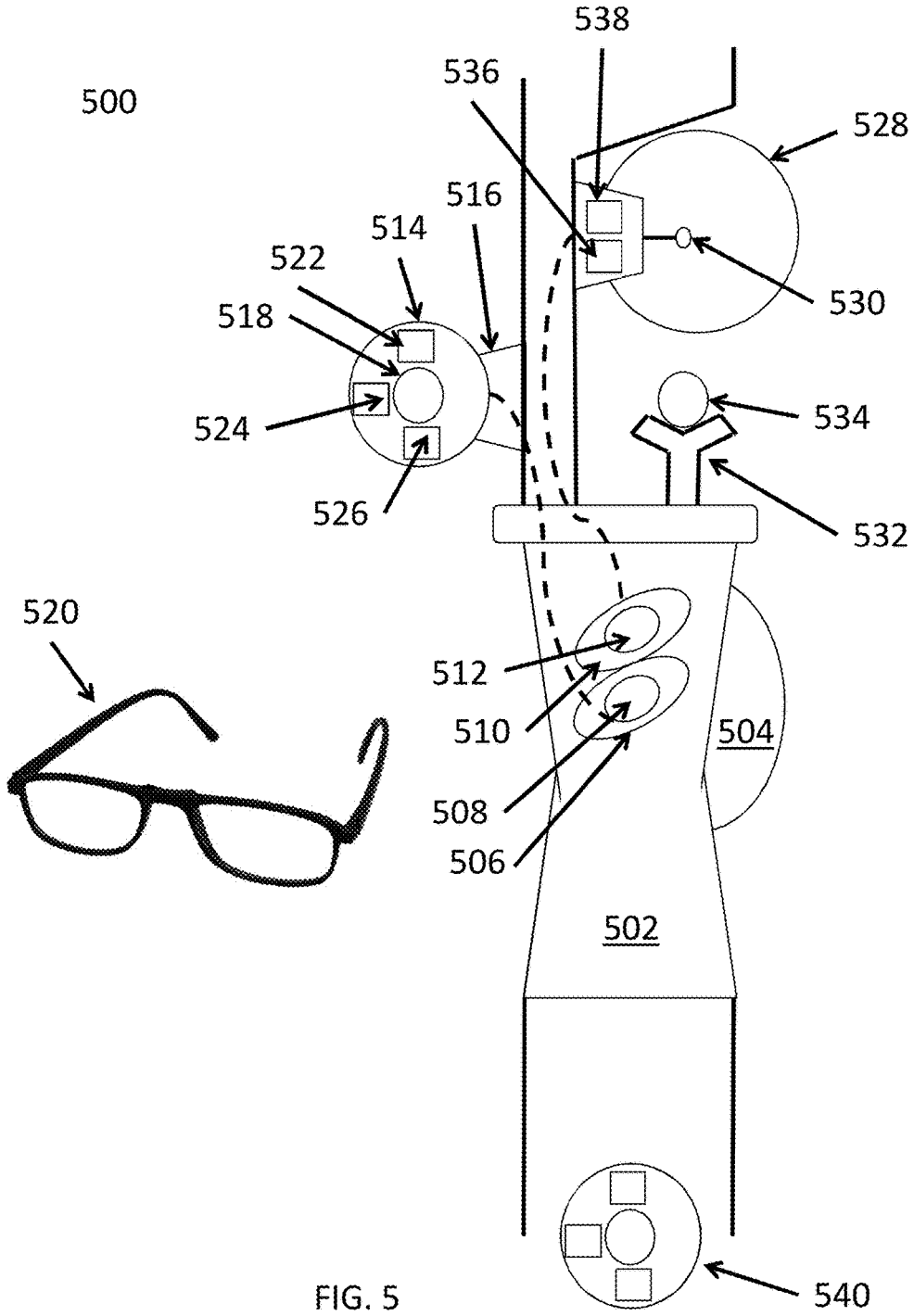
FIG. 5 illustrates a grip and sighting system incorporating teachings of the present disclosure.
Figure 6:
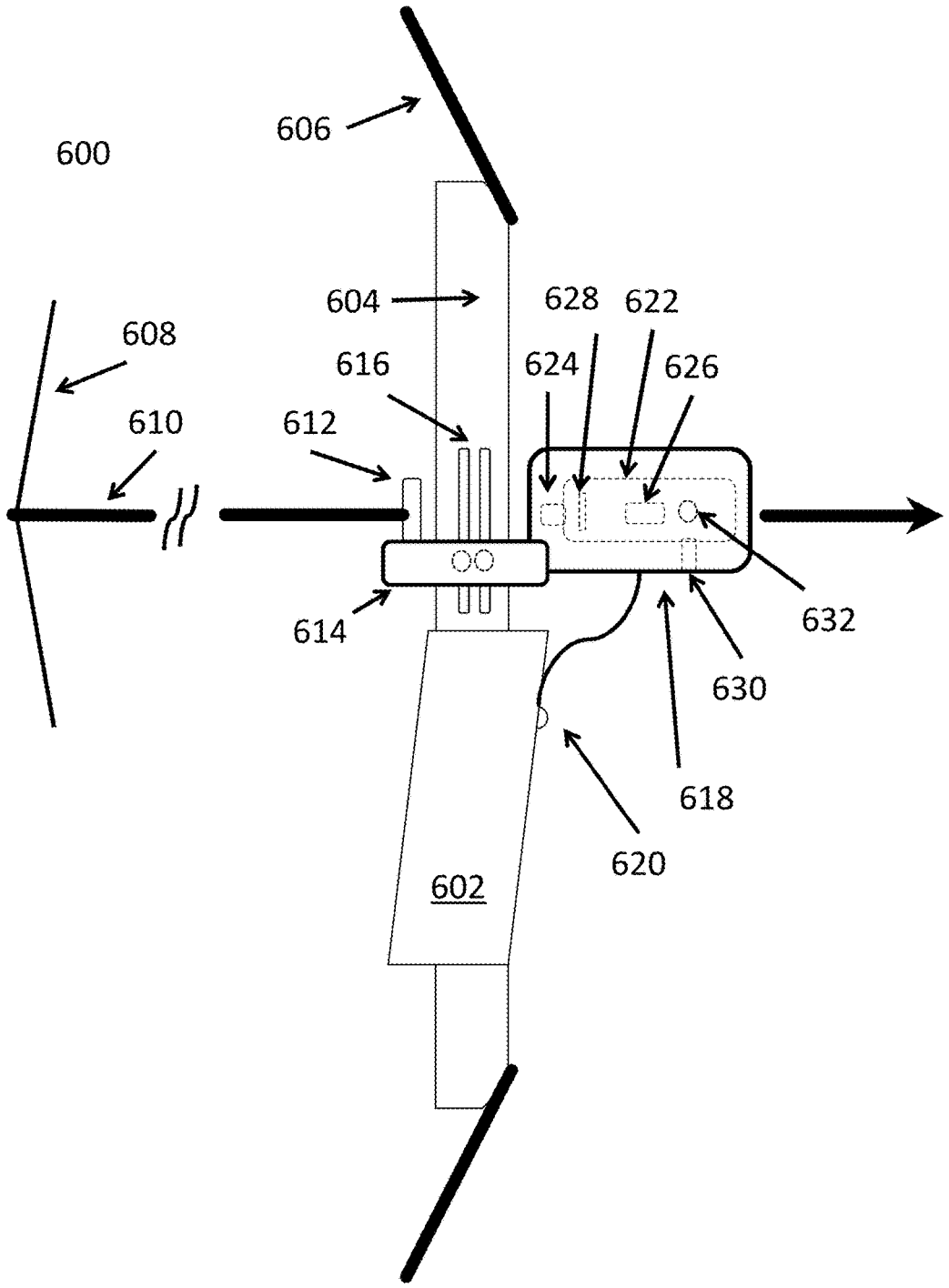
FIG. 6 illustrates a view of a grip and sighting system incorporating teachings of the present disclosure.

As mentioned above in the Brief Description of the Drawings, FIG. 4 illustrates an archery system 400 incorporating teachings of the present disclosure, and FIG. 5 and FIG. 6 illustrate a grip and sighting system incorporating teachings of the present disclosure. To be clear, a designer may pick and choose from the many teachings included within this disclosure when creating his or her system. A given figure may focus more on a particular teaching, but a designer will know to take a teaching from FIGS. 1A and 1B and combine it with a teaching from FIG. 5. Portions of this detailed description may explain various teachings one at a time, but a designer will know that the teachings can be combined and/or separated to accomplish the designer's goals. This combination and/or separation is facilitated by the disclosure and does not depart from the spirit and scope of the inventions.

Referring to FIG. 4, system 400 includes a compound bow 402 that has several components. Pin sight 404 and stabilizer 406 are attached to bow 402. In addition, bow 402 includes a grip 408, which may be similar to system 100 described in FIGS. 1A and 1B. Grip 408 also includes a laser on switch 410, which may be an on and off button for a laser module capable of emitting a beam along an optical axis.

In practice, the laser module may be an archery laser sighting system that includes a housing and a mounting system that connects to a portion of a bow and an emitter that emits a beam along an optical axis. The module may connect to the bow in a manner that substantially precludes movement. For example, the body of the bow may include machined female threads and the mounting system may allow machined bolts to pass through a portion of the mounting system and to connect to the bow via the female threads already located in the body of the bow.

In one configuration, the laser module may be incorporated into grip 408. And, securing grip 408 to the body of the bow may effectively secure the laser module to the bow as well. In some configurations, the laser module 412 may be mounted to bow 402 in a location that allows an emitted beam to be at or near the same height as an arrow rest to help reduce sighting parallax challenges. As such, an emitted laser 414 may be emitted on the same horizontal plane as the arrow at launch. Some designers may choose to combine the emitter with a bow component, such as stabilizer 406, which allow an emitted laser 416 to come from a different vertical location on the bow.

As shown, a bow may include two or more emitters. The emitter or emitters may be located apart from one another, located next to one another, or located in the same place. The emitter or emitters may be incorporated into a bow grip, into an add-on component that bolts to a bow, and/or in some other appropriate place.

In one system, a first emitter may be "sighted in" such that an emitted laser (e.g., emitted laser 414) presents a dot or other shape on a target, and if the target is 25 yards away, the presented dot may roughly indicate where a loosed arrow will strike the target. Similarly, a second emitted laser (e.g., emitted laser 416) may be "sighted in" such that the presented dot may roughly indicate where a loosed arrow will strike the target if the target is 35 yards away. The number of sightable emitters may be one, two, three, four, or more. And, the sighted in distances may be adjustable. For example, an archer may want a 20 yard laser, a 30 yard laser, and a 40 yard laser. In practice, each sightable emitter may emit beams of different colors. A 20 yard laser might be red, a 30 yard laser might be green, and a 40 yard laser might be yellow. The number of sightable emitters, the color of the emitted beam or beams, and the presented on-target image (e.g., a dot, a chevron "^", an "X", a crosshair "+", a bullseye, etc.) may be adjusted depending upon a designer's goals. Moreover, a designer may give the archer the ability to change any or all of these elements. For example, a system may be adjustable and give the archer a choice of how many lasers, what colors, and what projected image (e.g., dot, chevron, and crosshair).

In some systems, laser on switch 410 may be a part of grip 408. In some systems, laser on switch 410 and laser module 412 may be added to bow 402 as after market solutions. In such a circumstance, laser on switch 410 may be electrically coupled to laser module 412 to facilitate communication of an ON or OFF signal. A triggering into an "ON" position may cause one emitter, two emitters, or more emitters to emit their respective beams. On switch 410 may be adjustable to allow a user to choose how many beams to emit. Similarly, on switch 410 may be sensitive to a direction of applied pressure by an archer, and this sensitivity may toggle the emitted laser, for example, from a 20 yard laser to a 30 yard laser. In some embodiments, the emitted laser may be selected based at least in part on a ranged distance of the target, and the ranging device may be associated with the bow to which the emitter is coupled. In addition, laser on switch 410 may be coupled to grip 408 using adhesives, hook and loop materials, or some other satisfactory mounting solution.

In some cases, grip 408 may include switch 410 and module 412, and grip 408 may include an injection molded housing made from an elastomer such as a glass and nylon composite material that is suitable for injection molding.

Whether incorporated into grip 408 or designed for mounting to some other portion of a bow, module 412 may include at least one or two alignment mechanisms. In practice, a screw with an allen wrench head may pass through a threaded hole extending through a housing component of module 412 to contact a portion of a laser emitter located within the housing. The two screws may be perpendicular to one another so that one screw can affect an elevation component of the emitted laser's optical axis and the other can affect a right or left component of the optical axis. To facilitate such an aiming solution, a laser emitter may have two ends, and one of the ends may be relatively fixed while the other end is capable of being affected by the alignment mechanism.

In another embodiment, a moveable end of the emitter may be moved with the help of two sliding rails oriented in a perpendicular fashion. Each rail may pass through a respective channel that can be loosened or tightened around the rail with a screw. To adjust the height of the aiming point of the laser, the elevation controlling channel may be loosened to allow the rail to be moved up or down within the channel. To adjust the aiming point to the right or left, the windage controlling channel may be loosened to allow the rail to be moved right or left within the channel.

A designer will recognize that there are other techniques for adjusting the aiming point of the emitted laser to help ensure that the aiming point of the emitted laser matches or closely matches the striking point of a loosed arrow from bow 402.

FIG. 5 presents a view from down range looking back at a system 500 that includes a grip 502 secured to a bow. Grip 502 includes a metacarpal offset 504, a first finger contacting portion 510, and an additional finger contacting portion 506. Contacting portion 506 includes an actuator 508 while contacting portion 510 includes an actuator 512.

As depicted, system 500 includes a laser module 514 that is electrically coupled to actuator 508 to facilitate a turning on and off of module 514. In practice, module 514 may be a laser system that provides an aiming point for an archer. For example, module 514 may emit a laser that "shows" where an arrow will impact when loosed from the bow. Given the effect of gravity on an arrow, an archer may choose an aiming point that corresponds to 20 or 25 yards from the bow. With modern compound bows, arrow flight is relatively flat from 0 yards to 20 or 25 yards.

In some embodiments, module 514 may act as a laser range finder and may communicate with pin sight 528. In such an embodiment, an archer may depress actuator 508 to engage a range finder feature of module 514. The measured range of module 514 may be available for communication to pin sight 528. In such a system, a depressing of actuator 512 may send a signal to pin sight 528, and mechanism 536 may adjust the location of pin 530 to account for the measured distance. In other words, pin 530 may be moved to account for the measured range. A solution like this may require pin sight 528 to have a power source 538. Power source 538 may provide power to mechanism 536 to facilitate a calculation of how far to move pin 530 as well as the power necessary to move pin 530.

As shown, laser emitter 518 may be located on a bow at a vertical height level with the center of a to-be-fired arrow 534 resting on a rest 532. Locating emitter 518 at the same height may reduce parallax errors. In practice, module 514 may be attached to the bow at pre-drilled locations on the bow body. With some embodiments, these pre-drilled locations may be the same locations at which rest 532 is attached to the bow. Mounting bracket 516 may be designed to facilitate this type of attachment.

Depending on design concerns, module 514 may want its own power source 522. Module 514 may also want elevation and windage sighting mechanisms 526 and 524, respectively. These sighting mechanisms may facilitate a "sighting in" of the laser after it has been attached to the bow. In addition, system 500 may want to include eye glasses 520. Glasses 520 may serve one or more functions. For example, glasses 520 may include a lens that facilitates a highlighting of a specific portion of the UV spectrum represented by an emitted laser. This may help an archer "see" the painted point of impact by the laser. For example, the glasses may cause a red, a green, a yellow, and/or other colors to appear brighter than they might otherwise appear. In addition, glasses 520 may have some degree of magnification to help the archer "see" downrange more effectively. As shown, while locating laser module 514 at arrow height may be preferably in some circumstances, a designer may choose to put the module in other locations. For example, a designer may choose to incorporate the module into a stabilizer as shown at stabilizer incorporated module 540.

FIG. 6 depicts one example of a mounted laser system 600. As shown, Grip 602 (which may be similar to system 100) includes an actuator 620 located on the front of the grip where an archer's finger may be located. Grip 602 is attached to a bow body 604, which attaches to limbs like limb 606.

String 608 can be attached to arrow 610, which is resting in a "whisker biscuit" type arrow rest 612. As shown, rest 612 is attached to the bow using attachment mechanism 614. Mechanism 614 is bolted to the bow through attachment channel 616, which are preformed into the bow. Laser module 618 is also attached to the bow via mechanism 614, and this dual attachment option facilitate alignment between arrow 610 and the optical axis of module 618.

As indicated above, actuator 620 is electrically coupled to module 618 to facilitate an ON and OFF toggling by the archer. Within module 618 may be a laser assembly 622 that includes a rear ball and socket joint 624, a light emitter 626, a power source 628 and elevation and windage adjusters 630 and 632. In practice, joint 624 may be relatively fixed while allowing ball and socket movement. This movement facilitates an adjusting of the indicated impact point of a loosed arrow. An archer can "zero" in the laser to the bow by adjusting elevation and windage adjusters 630 and 632 after module 618 has been secured in position. In some cases, the adjustments are fixed for a given distance (e.g., 20 or 25 yards from the bow). In other cases, the "zero" point may be adjusted in real time to account for a ranged distance of the target that is different than the pre-sighted 20 or 25 yards.

A system incorporating teachings of the present disclosure may replace, add, or delete many of the above-described features without departing from the scope of the disclosure. One skilled in the art will recognize that the many of the above-described components could be combined or broken out into other combinations.

Although the present invention has been described in detail, it should be understood that various changes, substitutions and alterations to the devices, methods, and other aspects and techniques of the present invention can be made without departing from the spirit and scope of the invention as defined by the appended claims.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A system, comprising:

a grip component configured to couple to a bow and to interact with an archer's lead hand, wherein the grip component comprises a vertical axis that is configured such that the vertical axis is parallel to a limb-to-limb line of the bow when the grip component is coupled to the bow;

a third metacarpal offset of the grip component, the third metacarpal offset to be adapted below a middle finger knuckle of the archer's lead hand when the archer grips the bow and configured to encourage a grip angle of between twenty degrees and sixty degrees with respect to the vertical axis;

a bow coupling system configured to facilitate a coupling of the grip component to the bow;

a front surface of the grip component that includes a touching location within a finger depression channel for a portion of a finger of the archer's lead hand; and a laser module for emitting a beam along an optical axis, the laser module having a laser on depression switch located at the touching location to facilitate a touching by the archer's lead hand when engaging the grip component.

2. The system of claim 1, wherein the laser module is incorporated into a stabilizer.

3. The system of claim 1, wherein the laser module is incorporated into the grip component.

4. A system, comprising:

a grip component configured to interact with an archer's lead hand and to couple to a bow, the grip component comprising a vertical axis configured to be parallel to a limb-to-limb line of the bow when the grip component is coupled to the bow and having a metacarpal offset, the metacarpal offset configured to encourage a grip angle of between twenty degrees and sixty degrees with respect to the vertical axis when the archer grips the bow with the archer's lead hand;

a thenar surface of the grip component, wherein at least a portion of the thenar surface has a convex cross-section and having a rake angle of less than twenty degrees with respect to the vertical axis;

a front surface of the grip component that includes a touching location for a portion of a finger of the archer's lead hand; and a laser module for emitting a beam along an optical axis, the laser module having an on and off depression switch located to facilitate a touching by the archer's lead hand when engaging the grip component.

5. The system of claim 4, wherein the laser module is incorporated into a stabilizer.

6. The system of claim 4, wherein the laser module is incorporated into the grip component.

7. The system of claim 4, wherein the on and off depression switch is incorporated into the grip component.

8. The system of claim 4, wherein the on and off depression switch is located at the touching location.

9. The system of claim 4, further comprising:

a range finding module for determining a distance of a target from the grip component having a ranging switch;

a sighting module for providing an indication of impact location of a loosed arrow, wherein the sighting module comprises the laser module; and a sight adjuster responsive to the range finding module and configured to adjust the sighting module to modify the indication of impact location of the loosed arrow based at least in part on the determined distance of the target.

10. The system of claim 4, wherein the grip component comprises a thumb-to-forefinger webbing structure configured to dissipate a pressure located on a webbing portion between a forefinger and a thumb of the archer's lead hand at full draw, wherein the thumb-to-forefinger webbing structure includes at least one of a fabric, a plastic insert, a rubber insert, a forefinger loop, a thumb loop, and a leather insert.

* * * * *